United States Patent [19]

Witt

[11] Patent Number: 5,025,875

[45] Date of Patent: Jun. 25, 1991

[54] ROCK BIT FOR A DOWN-THE-HOLE DRILL

[75] Inventor: Lewis Witt, Roanoke, Va.

[73] Assignee: Ingersoll-Rand Company, Woodcliff Lake, N.J.

[21] Appl. No.: 519,596

[22] Filed: May 7, 1990

[51] Int. Cl.[5] ..... E21B 10/00

[52] U.S. Cl. ..... 175/393; 175/410; 175/418

[58] Field of Search ..... 175/393, 101, 410, 421, 175/417, 418

[56] References Cited

U.S. PATENT DOCUMENTS

| | | | |
|---|---|---|---|
| 2,368,512 | 1/1945 | Zimmerman | 175/400 |
| 2,879,973 | 3/1959 | Saxman | 175/410 |
| 2,938,709 | 5/1960 | Curtis | 175/390 |
| 3,382,940 | 5/1968 | Stebley | 175/410 |
| 3,452,832 | 7/1969 | Ditson | 175/418 |
| 3,608,654 | 9/1971 | Powell et al. | 175/237 |
| 4,299,298 | 11/1981 | McEnery et al. | 175/418 |
| 4,323,130 | 4/1982 | Dennis | 175/410 |
| 4,406,336 | 9/1983 | Olsen et al. | 175/410 |
| 4,676,324 | 6/1987 | Barr et al. | 175/385 |
| 4,697,654 | 10/1987 | Barr et al. | 175/410 |
| 4,819,746 | 4/1989 | Brown et al. | 175/296 |
| 4,883,136 | 11/1989 | Trujillo | 175/393 |

FOREIGN PATENT DOCUMENTS

| | | | |
|---|---|---|---|
| 645377 | 3/1964 | Belgium | 175/410 |
| 155026 | 9/1985 | European Pat. Off. | 175/410 |

*Primary Examiner*—Ramon S. Britts
*Assistant Examiner*—Roger J. Schoeppel
*Attorney, Agent, or Firm*—Glenn B. Foster; James R. Bell

[57] ABSTRACT

A rock bit for a down-the-hole drill provides auxiliary flow paths for flushing the working face of the drill bit to facilitate the removal of cuttings and debris through peripheral troughs in the drill thereby significantly reducing the abrasive effect of the cuttings and debris on the bit body. The exhaust fluid is supplied to the working face of the drill bit through several delivery channels spaced equidistantly about the periphery of the drill head where a first set of delivery channels are disposed at acute angles to the central axis of the drill bit and a second set of delivery channels are interposed directly between the central bore of the drill bit and the working face.

10 Claims, 5 Drawing Sheets

ROCK BIT FOR A DOWN-THE-HOLE DRILL

BACKGROUND OF THE INVENTION

This invention relates generally to a rock bit for down-the-hole drilling and more particularly the rock drill bit having passages for the discharge of cuttings using a fluid operated percussive drill motor.

A continuing problem exists in providing an adequately controlled flow of a flushing medium to the multicutting bit inserts provided in the face of a rock drill bit. Removal of cuttings and debris from the face of a rock bit is vital, if such bit is to continue to drill efficiently and to have an economical service life. Cuttings removal is customarily done by the introduction of an exhaust fluid into or near the working bottom of the drilled hole, usually through the drill bit body itself. In established down-the-hole drilling practices, fluid turbulence and constricted flow circuits for the flushing fluid serve to erode the bit body rather variably, and thus reduces the overall effective working time.

Existing bits that are employed with downhole, pneumatically driven rock drills (DHD's), typically are provided with one or more machined passages leading into the bit face or are located on the periphery of the face. Such directly engage the rock bottom of the drilling bore hole. The fluid outlets act as dual means to exhaust the operating air from the DHD and for flushing rock cuttings and debris away from the working face, permitting their continuous removal from the bore hole.

Since all of the spent air that operates the DHD is exhausted across the bit face, usually from about the bit axis to the outer periphery of the bit, the high volumetric air flows used and the consequent fluid flow velocity across the bit face and about the adjacent skirt become substantial, causing strongly abrasive wear of the bit body. This is especially so near the periphery of the bit body.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by providing a rock bit for a down-the-hole drill which includes an elongated shank adapted to be operatively connected at its distal end to a drill string and to a source of fluid pressure which actuates the drilling action; a head having a generally planar working face, the head being preferably, but not exclusively, formed integrally with the shank, and being provided with an array of cutting inserts located about the face; an axially aligned, first bore-like passage connected to the fluid source and terminating within the shank at a point spaced apart from the working face, the first axial passage adapted for supplying exhaust fluid received from the drill motor to the drill bit head; two or more radially aligned, secondary passages connecting at their inner end from the first axial passage proximate its inner end to the periphery of the shank, and being sized for supplying a major percentage of exhaust fluid flowing to the bit head periphery; at least one axially aligned and substantially reduced diameter tertiary passage communicating between the inner end of the axial bore and the working face of the head for supplying a minor portion of exhaust fluid flow to the working face; a peripheral exhaust flow channel connecting between the outer end of each of the secondary radial passages and the working face for supplying a major portion of the exhaust fluid flow to the working face; two or more peripheral cuttings flow exit troughs adapted for passing cuttings-loaded exhaust fluid from the working face, with each of the exit troughs originating in the working face at a point intermediate of the axial center of the head and of its perimeter with such exit troughs terminating on the periphery of the shank between the peripheral exhaust flow channel; the flow area of the secondary radial passages coupled with the peripheral exhaust flow channel relative to the flow area of at least one tertiary axial passage is such that their countercurrent flow patterns maintain a positive fluid pressure across the working face relative to the flowing fluid pressure existing in the exit troughs; and a surface on the shank defining an inwardly oriented shoulder spaced back from the working face of the head and providing an annular channel about the shank adapted for receiving the cutting fluids passing from the working face through the exit troughs and for passing the same to the surface via the drill pipe annulus.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
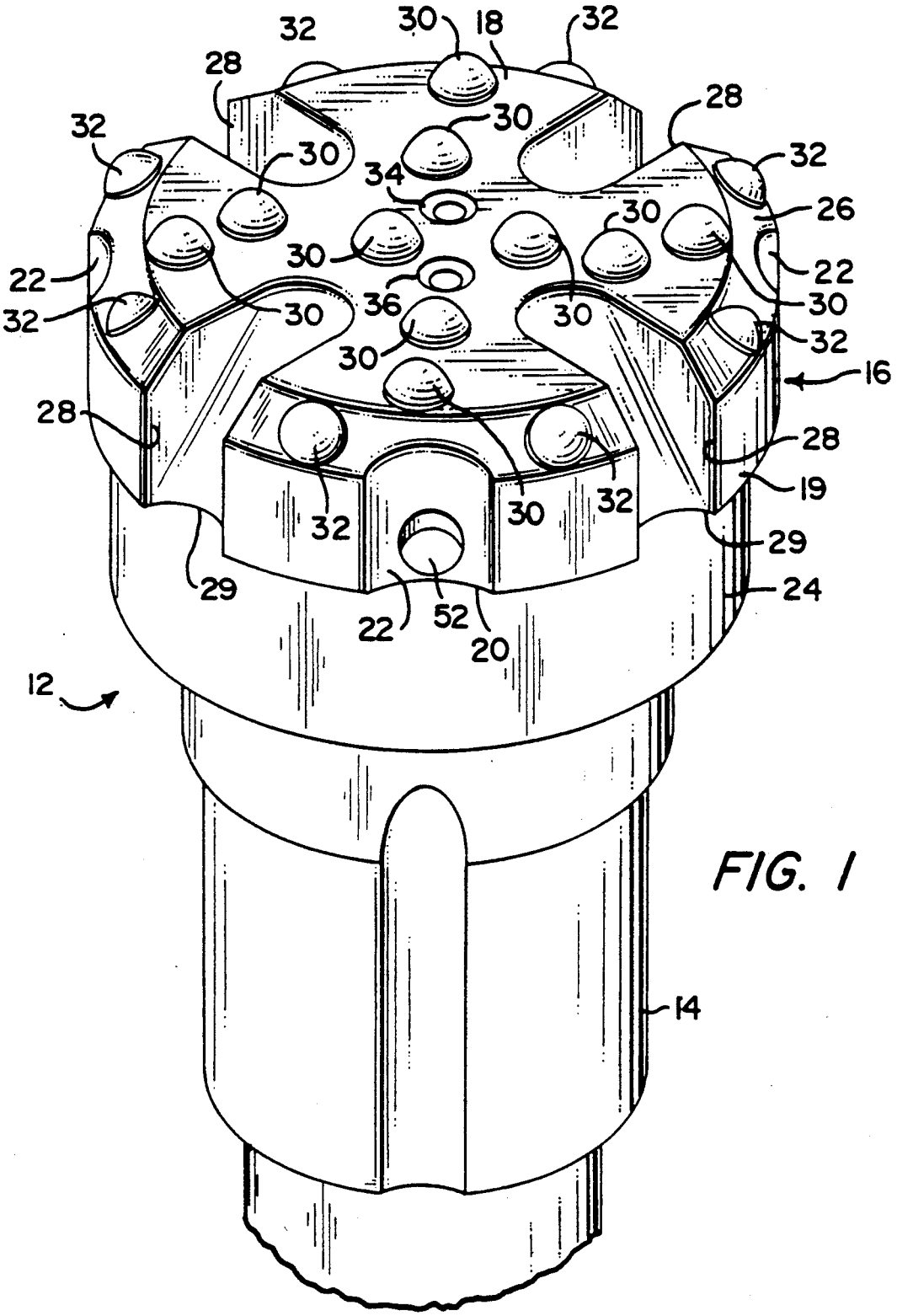
FIG. 1 is a perspective view illustrating an embodiment of a percussion drill bit body from the working end, depicting the machined surfaces of the invention.

Referring now to the drawings in detail, wherein like numerals designate like elements, or parts, there is depicted in FIG. 1, a percussive drill bit 12 of the first embodiment, which comprises of a solid metal elongated shaft, or shank, 14 adapted for connection at its distal end to a drill string and a source of fluid pressure (not shown), conveniently high pressure air, sufficient to activate the drill bit. The proximal or working end has an enlarged head portion 16 presenting a generally planar working face 18. Symmetrically arrayed about the periphery of sidewall 19 of head 16 are curvilinear-shaped undercuts, 20, which define a peripheral passageway 22, between the recessed shoulder portion 24 of head 16 and the peripheral beveled edge 26 of the bit working face 18. Arrayed alternately with undercuts 20 in the head sidewall, and aligned in cater-corner fashion, are larger semi-cutting flow exit troughs 28, which bridge between the working face 18 and the sidewall 19 of head 16.

Mounted in a somewhat organized pattern across the drill working face 18 are a plurality of "buttons" 30, usually carbide tipped inserts, most of which are axially oriented so as to provide direct drilling contact with an opposing bore hole surface. The inner buttons are encompassed by a circular array of peripheral, or gage buttons, like 32, which engage the bore hole surface, but at an inclined posture relative to the bore hole sidewall.

Disposed on either side of the geometric axis of the drill bit face are a pair of exhaust ports, 34 and 36, representing the outer terminals of two linear bores (not shown) that are included within the shank with the main exhaust fluid supply bores and connecting with the main exhaust fluid supply bore to the bit head 16. These linear bores communicate with a larger axial bore, the configuration and function of which (exhaust fluid supply) will be described in relation to the sectional views of FIGS. 3 and 4.

Figure 2:
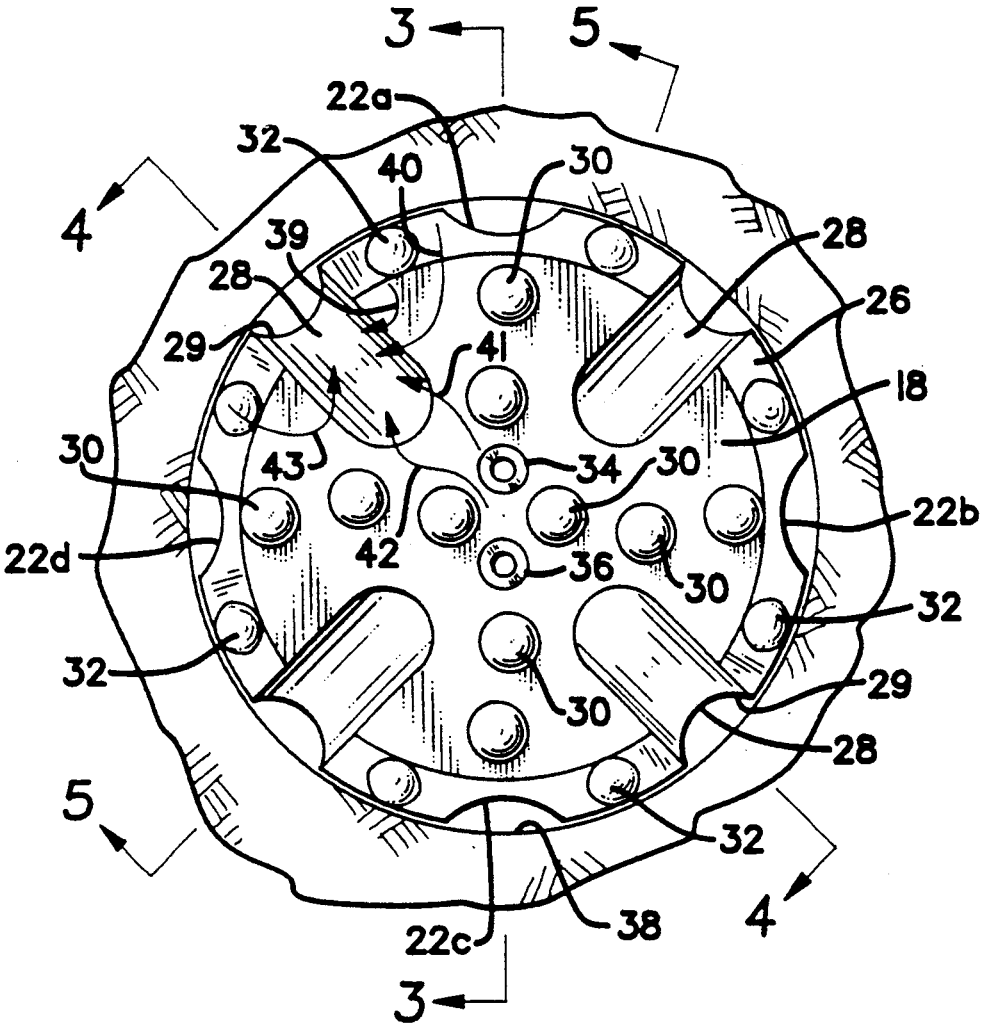
FIG. 2 is an elevational end view (proximal) of the drill bit body of FIG. 1.

In FIG. 2, the generally cylindrical drill bit head 18 is shown as encased in the bore hole 38. It will be seen that (of the four) peripheral exhaust flow channels 22*a* to 22*d* are preferably aligned in diametrically opposing fashion, and so to present an aggregate cross-sectional area (four main ports) for exhaust fluid supply into the working face 18. This flow area is several times greater than the cross-sectional flow area of the two central ports 34 and 36. The four somewhat larger exit troughs 28, also have cross-sections at their peripheral ends 29, that are somewhat larger than the combined exhaust flow channels 22 and central exhaust ports 34, 36. This variance in the flow areas facilitates the escape of cuttings-loaded exhaust fluid from the working face 18.

A plurality of inwardly pointing directional arrows 39–43 (FIG. 2), indicate how, under typical drilling conditions, entering exhaust fluid sweeps across the working face, generally inwardly, and thus largely avoids abrasive contact with the peripheral beveled edge 26, sidewall 19, and game button 32. The directional flow across the working face 18 permits only minimal overflow of the inner array of aligned buttons 30. All of the exhaust fluid introduced across the working face 18 then exits via the inclined troughs 28 to the head periphery through the trough ends 29.

Figure 3:
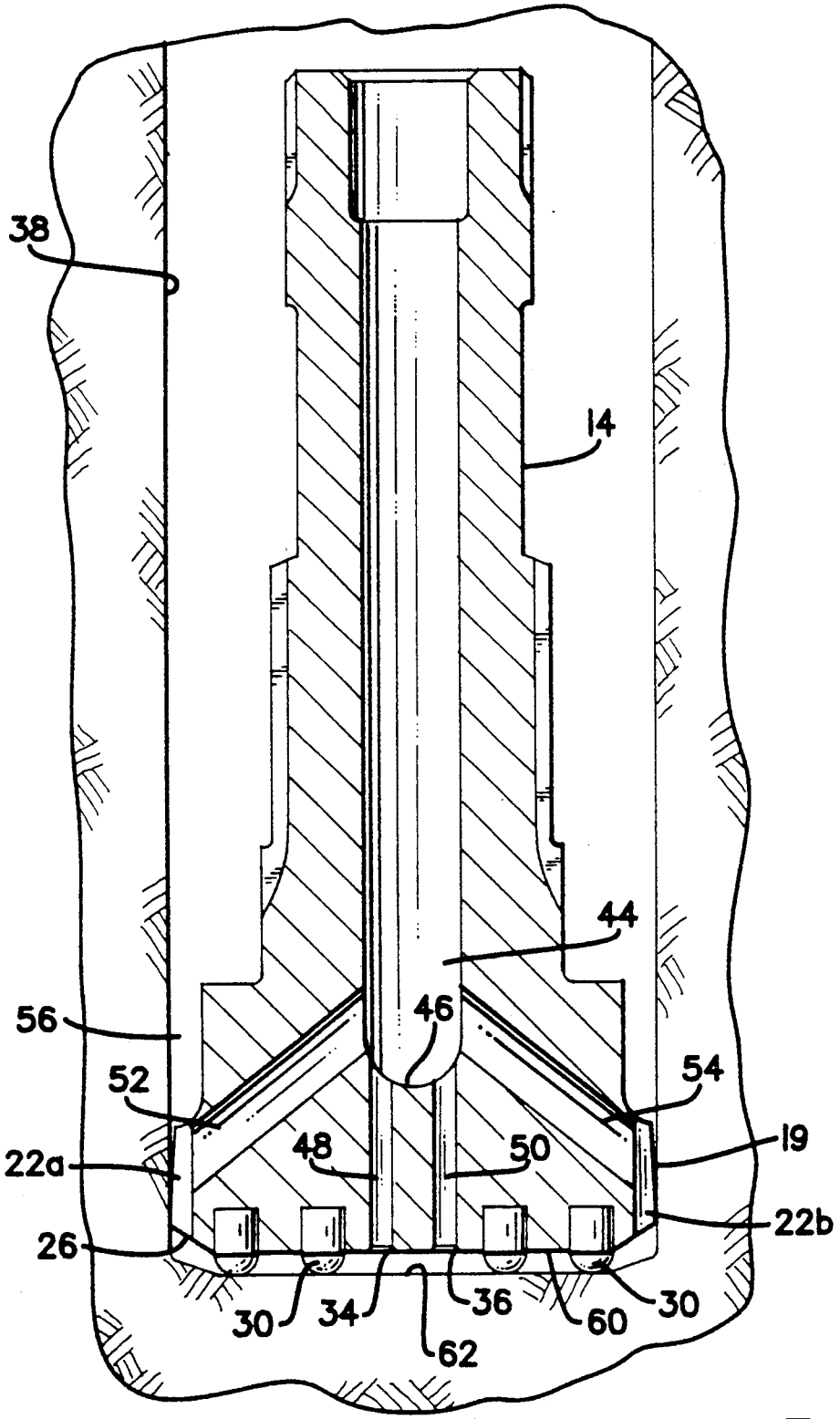
FIG. 3 is a vertical cross-sectional view of a first embodiment of the drill bit of FIG. 1, extending the length of the shank, taken, on line 3—3 of FIG. 2.

To recapitulate the pathways of the exhaust fluid in flushing the bit face, reference should be made to FIG. 3. Exhaust fluid flows down via central bore hole 44 which itself dead ends well short of working face 18 on the head 16. Two linear passages 48 and 50 extend axially between the central bore end 46 and the exit, or exhaust ports 34, 36, permitting fluid flow to the working face. Also two generally radially aligned secondary passages 52, 54, both of which are preferably forwardly inclined, are coupled between the proximal closed end 46 of central bore 44 and to the machined channels 22 in the peripheral sidewall 19 of bit head 16. Channels 22 communicate between the proximal working face headroom 60 and the rearwardly-located annular channel 56, that is cut back in the distal sidewall of the bit head. The axially aligned cutting bits 30 span the receding gap 60 between working face 18 and bore hole facade 62 during drilling.

Figure 4:
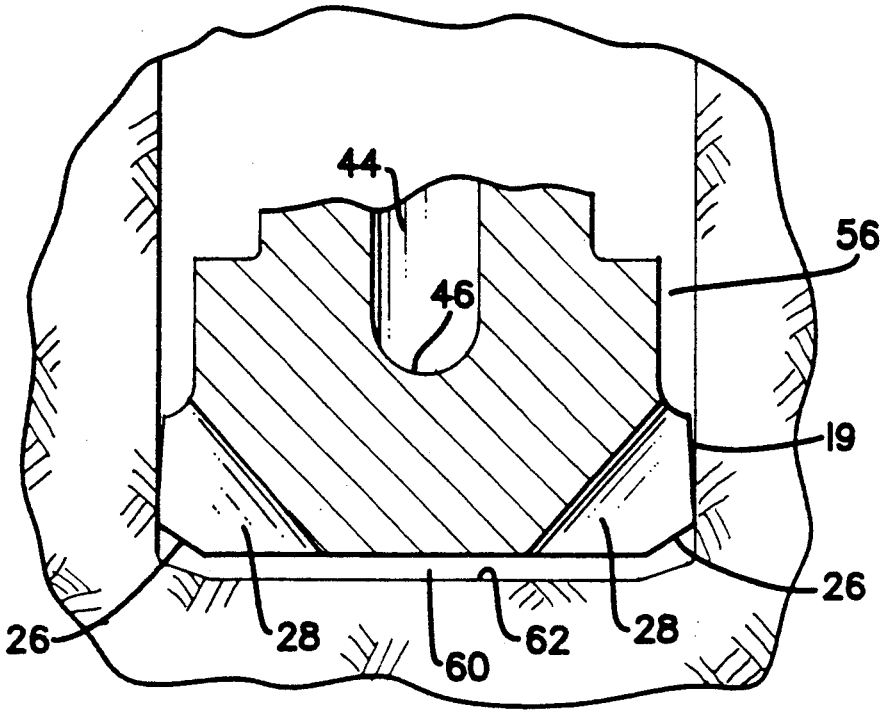
FIG. 4 is a second cross-sectional view of the drill bit, partially fragmentary, taken on line 4—4 of FIG. 2.

In the alternate sectional view of FIG. 4, the configuration of cuttings flow exhaust troughs 28 is better seen. They communicate directly with the rearward, annular channels 56 in the shank for facilitating transport of exhaust fluid and debris uphole to the surface. In this view, central bore 44 is fully isolated accessing the bit face only via the passageways 48, 50, 52, 54, exhaust flow channels 22 and exhaust ports 34, 36 of FIG. 3.

Figure 5:
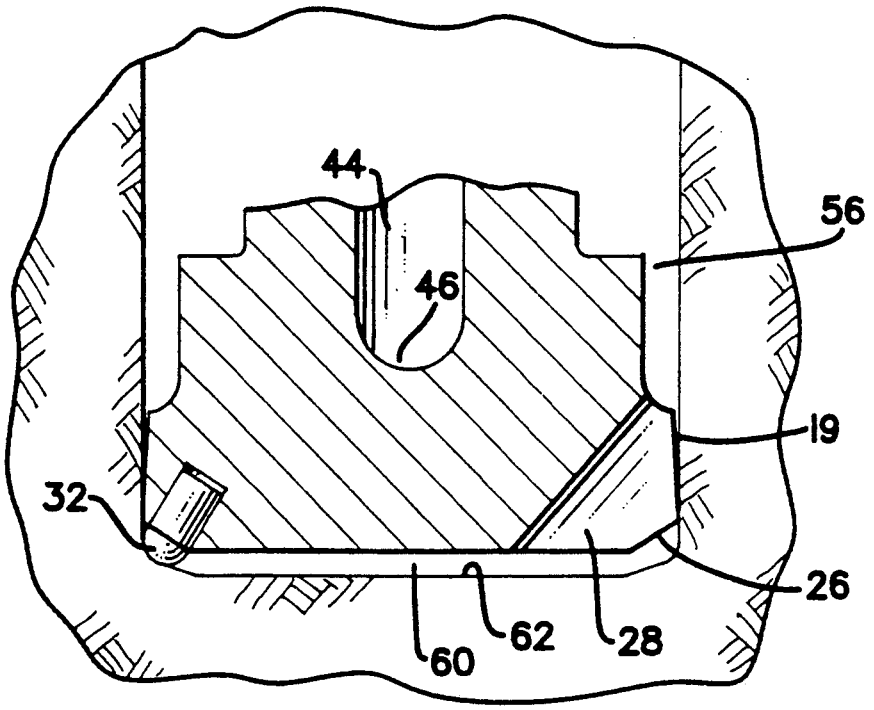
FIG. 5 is a third cross-sectional view of the drill bit, partially fragmentary, taken on line 5—5 of FIG. 2.

In the third sectional view of the drill bit (FIG. 5), the erosion-vulnerable inclined gage buttons 32 are noted as making an essentially abrasive contact between the drill bit peripheral edge 26 and the bore hole 62 perimeter. Such contact requires inlet exhaust fluid to enter the working gap 60 of bit face 18 mostly via the intervening peripheral channels 22 and the central exhaust ports 34, 36. The cuttings-loaded exhaust fluid then exits through the four cater-cornered troughs 28.

Figure 6:
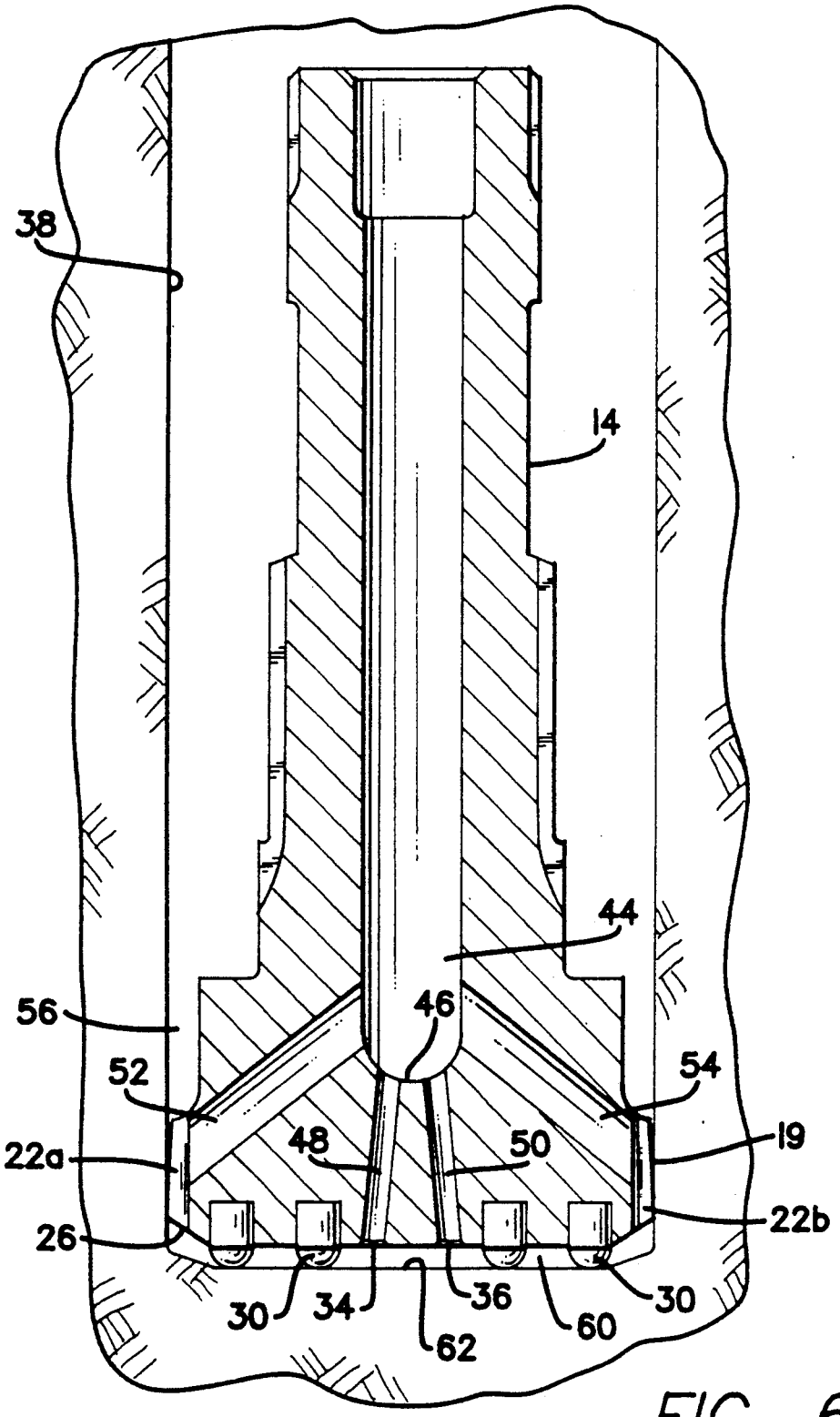
FIG. 6 is a vertical cross-sectional view illustrating a second embodiment of the drill bit of FIG. 1 showing divergent central exhaust fluid inlet passages.

Referring now to FIG. 6, an alternate method of delivering the exhaust fluid to the working face 18 through the central exhaust ports 34, 36 is to arrange the central passages 48, 50 in a manner such that there exists a divergent angle between the passages 48, 50 from the end 46 of the central bore 44 and the working face 18 of the drill head 16. This divergence adds to the flow of the exhaust fluid across the working face 18 which will lengthen the service time of the drill inserts by reducing the abrasive force.

As to materials of construction, the bit inserts are customarily of tungsten carbide, as is well-known in the art. The drill bit and shank are of steel.

As to the configuration of the internally located flow inlet passages, radial bores 52, 54 are necessarily inclined toward the working face to an appreciable degree. The most acute angle, measured relative to the shank axis, is preferable to insure optimum inlet fluid flow and sweep efficiency across the working face periphery. The acute angle of radial passages 52, 54 is the maximal consistent with intercepting the peripheral channels behind the working face and between the carbide tipped bit inserts. Concurrently, at its distal (inner) end, the radial passages must be fashioned so as to avoid a weakened wall between the passage itself and the greatly reduced diameter of the drill shank somewhat rearward of the working face.

Comparative tests have shown that a drill bit fabricated in accordance with the present invention can offer appreciable practical advantages over a conventional DHD hammer drill fitted with a bit exhausting to the periphery. In preliminary trials of drills under simulated operating conditions, it was noted that erosion and wear of bits have been substantially reduced, in some instances increasing the service life of the gage buttons more than 50% compared to using state of the art bits.

Having described the invention, what is claimed is:

1. A rock bit for a down-the-hole drill, the bit comprising:

an elongated shank adapted to be operatively connected at its distal end to a drill string and to a source of fluid pressure which actuates the drilling action;

a head having a working face and a periphery and a center, said head being provided with an array of cutting inserts located about said face;

at least one central exhaust port disposed on said working face adjacent to said center of said working face;

an axially aligned, first bore-like passage means connected to the fluid source and terminating within the shank at a point spaced apart from said working face, said first axial passage means adapted for supplying exhaust fluid received from said source of fluid pressure to the drill bit head;

two or more radially aligned, secondary passage means connecting at their inner end from the first axial passage means proximate its inner end to the periphery of said shank, and being sized and oriented for supplying a major percentage of the total exhaust fluid flowing both to the working face and to the bit head periphery;

at least one axially aligned and substantially reduced diameter tertiary passage means communicating between said inner end of the axial bore and said at least one central exhaust port disposed on said working face of said head and being sized for supplying a minor portion of the total exhaust fluid flowing both to the working face and to the bit head periphery;

a peripheral exhaust flow channel means formed by undercuts in said periphery of said head and connecting between the outer end of each of the secondary radial passage means and the working face for supplying a major portion of the total exhaust fluid flowing both to the working face and to the bit head periphery;

two or more peripheral cuttings flow exit through means adapted for passing cuttings-loaded exhaust fluid from the working face with each of said cuttings flow exit trough means originating in said working face at a point intermediate of the axial center of said head and of its periphery and between said peripheral exhaust flow channel means with such cuttings flow exit trough means terminating on the periphery of the shank between said peripheral exhaust flow channel means; said peripheral exhaust flow channel means being spaced on said periphery so as not to supply exhaust flow directly to said cuttings flow exit trough means, and wherein the total flow area of the secondary radial passage means exceeds the total flow area of the at least one tertiary axial passage means;

surface means on the shank defining an inwardly oriented shoulder spaced back from the working face of the head and providing an annular channel about the shank adapted for receiving the cuttings loaded exhaust fluid passing from said working face through said cuttings flow exit trough means and for passing the same to the surface via said annular channel.

2. The rock bit of claim 1, wherein the secondary radial passage means are inclined at an acute angle relative to the longitudinal axis of the shank and the main axial bore in the direction of said head to foster predominant exhaust fluid flow to the periphery of said working face of the drill between the cutting inserts.

3. The rock bit of claim 1, wherein the exhaust flow channel means for exhaust fluid flow are arrayed equidistantly about the periphery of the drill head.

4. The rock bit of claim 1, wherein the inlet ends for the cuttings flow exit trough means for cuttings loaded exhaust fluid are arrayed equidistantly on the working face, alternating with the peripheral exhaust flow channel means.

5. The drill bit of claim 1, wherein said cuttings flow exit trough means are equal in number to said peripheral exhaust flow channel means.

6. The drill bit of claim 1, wherein said exhaust flow channel means and said cuttings flow exit trough means are located in alternating sequence and are essentially spread equidistantly across the working face of the drill head.

7. The drill bit of claim 1, wherein a certain number of the bit cutting inserts are arrayed about the periphery of said drill working face and alternating between said exhaust flow channel means and said cuttings flow exit trough means.

8. The drill bit of claim 1, wherein the radial cross-sectional area of said cuttings flow exit trough means is substantially greater than the combined cross-sectional area of said exhaust flow channel means and said at least one central exhaust port.

9. The drill bit of claim 1, wherein there are at least two tertiary passage means for exhaust fluid inflow and they present a divergent angle between the first passage means inner end and the working face of said drill head.

10. A rock bit for a down-the-hole drill, comprising:

a bit body;

a central bore in the bit;

a working face on the bit, said working face having both a center and a periphery;

cuttings flow exit troughs formed in said periphery;

auxiliary means for flushing the working face of the bit with exhaust fluid to facilitate the removal of cuttings and debris through said cuttings flow exit trough for significantly reducing abrasive wear on the bit body, the exhaust fluid being supplied to the working face of the bit through several delivery channels, where a first set of the delivery channels are disposed at acute angles to a central axis of the bit facing said working face and are sized for supplying a major portion of the total exhaust fluid supplied to said working face to said periphery and a second set of the delivery channels are interposed directly between said central bore in the bit and the working face and are sized for supplying a minor portion of the exhaust fluid supplied to said working face to the center of said working face, wherein said first set of delivery channels supply exhaust fluid to said working face and not directly into said cuttings flow exit troughs.

* * * * *